US006089223A

United States Patent [19]

Jasper et al.

[11] Patent Number: 6,089,223

[45] Date of Patent: Jul. 18, 2000

[54] DIRECT CONTACT WATER HEATING SYSTEM

[75] Inventors: Robert Jasper, Cushing; Bill O. Rollings, Glenpool; Mark Dunbar, Tulsa, all of Okla.

[73] Assignee: Webco Industries, Incorporated, Sand Springs, Okla.

[21] Appl. No.: 09/014,795

[22] Filed: Jan. 28, 1998

[51] Int. Cl.[7] ..... F24H 1/10; F23D 14/46

[52] U.S. Cl. ..... 126/355; 126/359; 126/380; 431/353; 122/20 A

[58] Field of Search ..... 126/355, 359, 126/350 R, 360 R, 380, 389; 122/20 A; 431/115, 116, 350, 353, 9

[56] References Cited

U.S. PATENT DOCUMENTS

| | | | |
|---|---|---|---|
| 1,820,755 | 8/1931 | McMullen . | |
| 2,218,281 | 10/1940 | De Ridder et al. | 252/372 |
| 2,759,328 | 8/1956 | Cockrell | 126/359 |
| 2,975,594 | 3/1961 | Eastman | 60/39.02 |
| 3,183,864 | 5/1965 | Stengel | 110/1 |
| 3,741,712 | 6/1973 | Delatronchette | 431/190 |
| 3,749,318 | 7/1973 | Cottell | 239/102 |
| 3,797,992 | 3/1974 | Straitz, III | 431/285 |
| 3,814,567 | 6/1974 | Zink et al. | 431/4 |
| 3,860,384 | 1/1975 | Vulliet et al. | 431/4 |
| 4,089,633 | 5/1978 | Barghout et al. | 431/208 |
| 4,089,639 | 5/1978 | Reed et al. | 431/211 |
| 4,275,708 | 6/1981 | Wood | 126/355 |
| 4,368,035 | 1/1983 | McCartny et al. | 432/13 |
| 4,394,118 | 7/1983 | Martin | 431/4 |
| 4,406,610 | 9/1983 | Duijvestijn | 431/4 |
| 4,538,981 | 9/1985 | Venturini | 431/190 |
| 4,574,775 | 3/1986 | Lutzen et al. | 126/359 |
| 4,634,370 | 1/1987 | Chesters | 431/202 |
| 4,658,803 | 4/1987 | Ball et al. | 126/355 |
| 4,753,220 | 6/1988 | Lutzen et al. | 126/355 |
| 4,771,762 | 9/1988 | Bridegum | 126/360 R |
| 4,773,390 | 9/1988 | Watts | 126/355 |
| 5,022,379 | 6/1991 | Wilson, Jr. | 126/116 R |
| 5,168,861 | 12/1992 | Lutzen et al. | 126/355 |
| 5,249,957 | 10/1993 | Hirata | 431/354 |
| 5,293,861 | 3/1994 | Mandeville et al. | 126/355 |
| 5,337,728 | 8/1994 | Maruyama | 126/344 |
| 5,341,797 | 8/1994 | Maruyama | 126/373 |
| 5,520,535 | 5/1996 | Heilman et al. | 431/353 |
| 5,620,316 | 4/1997 | Duboudin et al. | 431/353 |
| 5,666,944 | 9/1997 | Ferguson | 126/391 |

*Primary Examiner*—Ira S. Lazarus
*Assistant Examiner*—Josiah C Cocks
*Attorney, Agent, or Firm*—Cherskov & Flaynik

[57] ABSTRACT

A direct contact water heating system employs a vertical water tower having a sidewall with a combustion inlet opening spaced above the tower lower end. A generally horizontal combustion chamber has a sidewall in communication with the tower combustion inlet and an end wall spaced from the water tower. A burner has a combustion outlet in communication with an opening in the end wall, the combustion chamber end wall having an annular area surrounding the burner combustion outlet. Products of combustion flow from the burner, through the combustion chamber into the water tower through the combustion inlet opening. A shell has an inner end attached to the water tower sidewall. A sidewall portion of the shell surrounds the combustion chamber sidewall and an annular portion is spaced exteriorly of the annular area of the combustion chamber end wall. An interior surface of the outer shell and an exterior surface of the combustion chamber form a closed envelope having a water inlet and a water outlet. A flow system passes water through the closed envelope to cool the combustion chamber. In a preferred embodiment the combustion chamber end wall and the shell annular portion are both frustums to provide more rigid support of the burner.

18 Claims, 4 Drawing Sheets

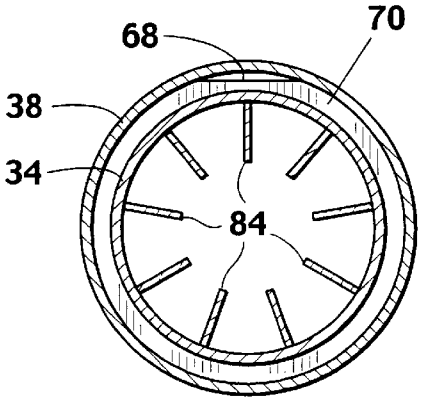
*Fig. 4*
*( PRIOR ART )*
*Fig. 3*
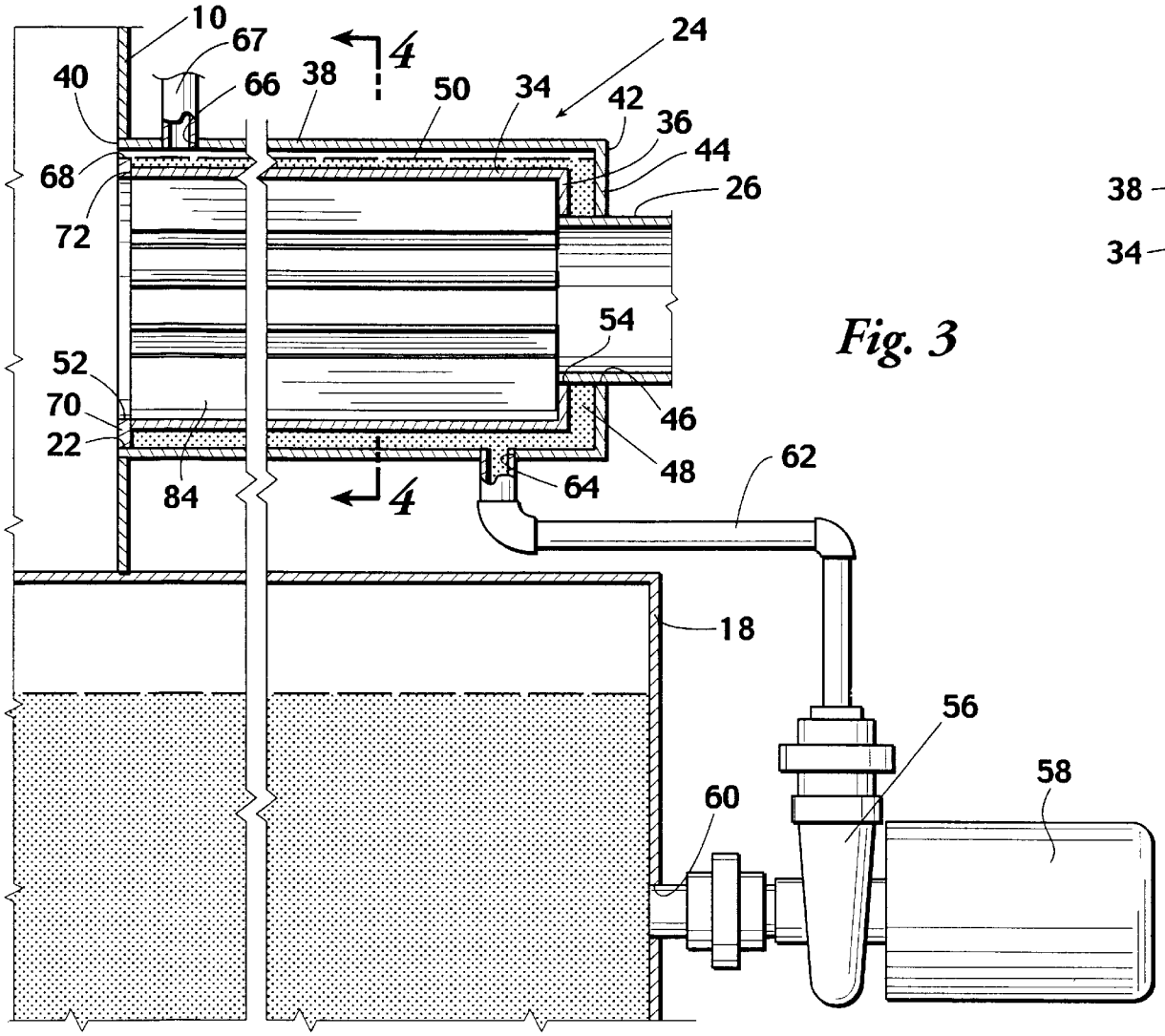

DIRECT CONTACT WATER HEATING SYSTEM

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

I. Field of the Invention

This invention relates to a direct contact water heating system and is of the type used primarily for industrial and commercial applications for fuel efficiently producing high volumes of hot water.

II. Background of the Invention

In a direct contact water heating system fuel is burned to produce a flame and hot gas products of combustion that are contacted directly with water to be heated to thereby achieve maximum transfer of heat of combustion to the water, resulting in extremely high efficiencies. An advantage of the direct contact water heating systems, in addition to high efficiency is that sterilization of the heated water is obtained. That is, a higher percentage of any entrained bacteria is killed by the direct contact of water with the gaseous products of combustion compared to other hot water heating systems wherein a membrane, whether of metal or some other material, separates the source of heat from the water being heated.

U.S. Pat. No. 4,773,390 issued Sep. 22, 1987 and entitled "Demand Hot Water System" and U.S. patent application No. 08/763,162 filed Dec. 10, 1996 and entitled "Hot Water Heating System" are good background sources for this disclosure. U.S. Pat. No. 4,773,390 describes a high efficiency hot water system in which fuel is combusted with the products of combustion contacting water to be heated within a water tower. The patent application discloses improvements, refinements and innovations to the basic concept of the demand hot water system described and illustrated in the patent.

For additional background information relating to hot water heating systems of the type commonly employed in industrial and commercial applications, reference may be had to the following previously issued United States patents:

| U.S. PAT. NO. | INVENTOR | TITAL |
|---|---|---|
| 1820755 | McMullen | Method of Preparing Liquid Fuel For Burning |
| 2218281 | De Ridder et al | Method For Cooling Flue Gas |
| 2975594 | Eastman | Generation of Power From Ash-Forming Hydrocarbons |
| 3183864 | Stengel | Method and System For Operating A Furnace |
| 3741712 | Delatronchette | Supply System For A Light Hydrocarbon-Water Emulsion Burner |
| 3749318 | Cottell | Combustion Method and Apparatus Burning An Intimate Emulsion Of Fuel and Water |
| 3797992 | Straitz, III | Crude Oil Burner |
| 3814567 | Zink et al | Smokeless Flare Using Liquid Water Particles |

-continued

| U.S. PAT. NO. | INVENTOR | TITAL |
|---|---|---|
| 3860384 | Vulliet et al | Method To Control Nox Formation In Fossil-Fueled Boiler Furnaces |
| 4089633 | Barghout et al | Combustion Vapor Generator |
| 4089639 | Reed et al | Fuel-Water Vapor Premix For Low Nox Burning |
| 4368035 | McCartny et al | Method and Apparatus For Heating Aggregate |
| 4394118 | Martin | Method and Arrangement For Reducing Nox Emissions From Furnaces |
| 4406610 | Duijvestijn | Process and Burner For The Partial Combustion Of A Liquid or Gaseous Fuel |
| 4538981 | Ventrurini | Combustion Catalyzing System For Commercial Grade Fuels |
| 4634370 | Chesters | Flare |
| 4771762 | Bridegum | Water Heater For Recreational Vehicle |
| 4773390 | Watts | Demand Hot Water System |
| 5022379 | Wilson, Jr. | Coaxial Dual Primary Heat Exchanger |
| 5249957 | Hirata | Emulsion Producing Apparatus and Its Combustion System |
| 5337728 | Maruyama | Liquid Heating Apparatus |
| 5341797 | Maruyama | Liquid Heating Apparatus |
| 5666944 | Ferguson | Water Heating Apparatus With Passive Flue Gas Recirculation |

In addition to these previously issued patents, the references cited against them that are not specifically enumerated hereinabove also form good background material relating to the subject of this invention.

BRIEF SUMMARY OF THE INVENTION

The direct contact water heating system of this disclosure has an upright water tower having a sidewall in which is formed a relatively large combustion inlet opening that is spaced intermediate the top and bottom end of the water tower. A smaller cold water inlet is provided adjacent the top of the tower and a hot water outlet is provided adjacent the bottom of the tower. The hot water outlet may be in the form of an open bottom of the tower. An intermediate water inlet may be provided below the cold water inlet and above the combustion inlet opening.

Extending generally horizontally from the water tower is a combustion chamber that is secured to the water tower at the combustion inlet opening. The combustion chamber has a burner secured to it having a fuel inlet. The burner functions to inject fuel into the combustion chamber. A draft producing fan is employed to cause air to flow through the combustion chamber which may be in the form of an induced draft or, in the illustrated embodiment, in the form of a forced draft fan by which air is injected from the burner into the combustion chamber. Combustion of fuel and forced air within the combustion chamber produces hot gases that pass from the combustion chamber directly into the water tower. The hot combustion gases move upwardly in the water tower to contact downwardly descending water so that heat of the hot gases of combustion is transferred directly to the water thereby achieving very efficient heat transfer.

A hot water storage tank may be connected to the water tower hot water outlet to provide a reservoir of hot water produced by the system. To maintain the temperature of the water in the reservoir, a recirculation system may be employed by which water is drawn from the hot water storage tank and recycled back into the water tower at an intermediate water inlet opening, the water passing downwardly through the water tower and back into the storage tank.

Combustion chambers are subjected to intense heat produced by burning fuel and are therefore exposed to a high rate of oxidation. To achieve longer combustion chamber life and to assist in the extraction of heat from the combustion process, it has been a practice to surround the wall of the combustion chamber of a direct contact water heater with an outer shell forming an annular chamber. A water inlet in this annular chamber is connected to receive inlet flow of cooling water. A passageway is provided between the interior of the annular chamber and the interior of the water tower for return flow of the cooling water.

Combustion chambers of the type described are subjected to substantially higher heat intensities than the outer shell, resulting in different rates of thermal expansion. To compensate for this difference the combustion chamber can be made to float free at its inner end, that is, the combustion chamber is sealed to the outer shell at the outer end adjacent the burner but the inner end is left free to move relative to the outer shell so that changes in thermal expansion do not impose stress on either the combustion chamber or the outer shell.

Combustion chambers for direct contact water heaters are typically cylindrical and horizontal and, as above indicated, the use of a shell around the horizontal combustion chamber that can receive the flow of water substantially extends the life of the combustion chamber and improves heat recovery efficiencies. A problem exists however with the end plate which supports the burner. The entire interior of the combustion chamber becomes hot and consequently the end plate of the combustion chamber is exposed to high heat. An improvement provided by the invention herein is a means of cooling the end plate so as to increase the life expectancy thereof and also to improve the efficiency of the direct contact water heater. This design may also have a residual effect of reducing any hot spots on the front face plate which should discourage the formation of $NO_x$ on the hot metal surface at the front face plate wall. The end plate is cooled by extending the shell which surrounds the cylindrical sidewall of the combustion chamber to encompass the end plate or more specifically, to encompass the annular area between the burner and the outer circumferential area of the combustion chamber.

A burner supported to a planar end plate of a combustion chamber of a high capacity hot water heater of the type above described causes vibration of the end plate. This vibration is caused by the effect of the high intensity flame within the combustion chamber that results in rapidly changing atmospheric pressure differentials across the chamber end wall. A combustion chamber configuration is disclosed herein that resists the tendency of the end plate of the combustion chamber to vibrate. This design also relieves stress on the end plate due to water pressure in the annular area for large outer diameter firing chambers. This improvement is achieved by shaping the end plate as a frustum, that is, the end plate is frusto-conical in configuration extending from the rearward end of the combustion chamber cylindrical sidewall in a rearward direction with reducing external diameters to meet the burner nozzle. This frusto-conical end plate is then matched by a frusto-conical shell that provides an annular area for cooling water to surround the combustion chamber frusto-conical end plate.

A better understanding of the invention will be obtained from the following description of the preferred embodiments and claims, taken in conjunction with the attached drawings.

DESCRIPTION OF THE DRAWINGS

FIG. 3 is an enlarged partial cross-sectional view of the lower portion of the direct contact water heating system of FIGS. 1 and 2.

FIG. 4 is a cross-sectional view of the combustion chamber as taken along the line 4—4 of FIG. 2. FIG. 4 is prior art and illustrates a known way of passing the flow of water from the interior of the shell surrounding the combustion chamber into the interior of the water tower.

DETAILED DESCRIPTION OF THE PREFERRED EMBODIMENTS

Figure 2:
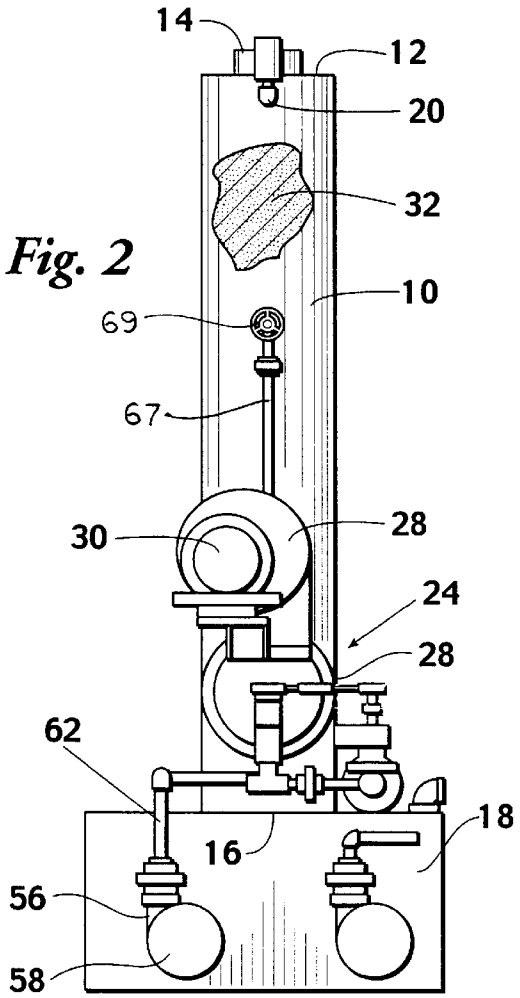
FIG. 2 is a front view of the direct contact water heating system of FIG. 1.
Figure 1:
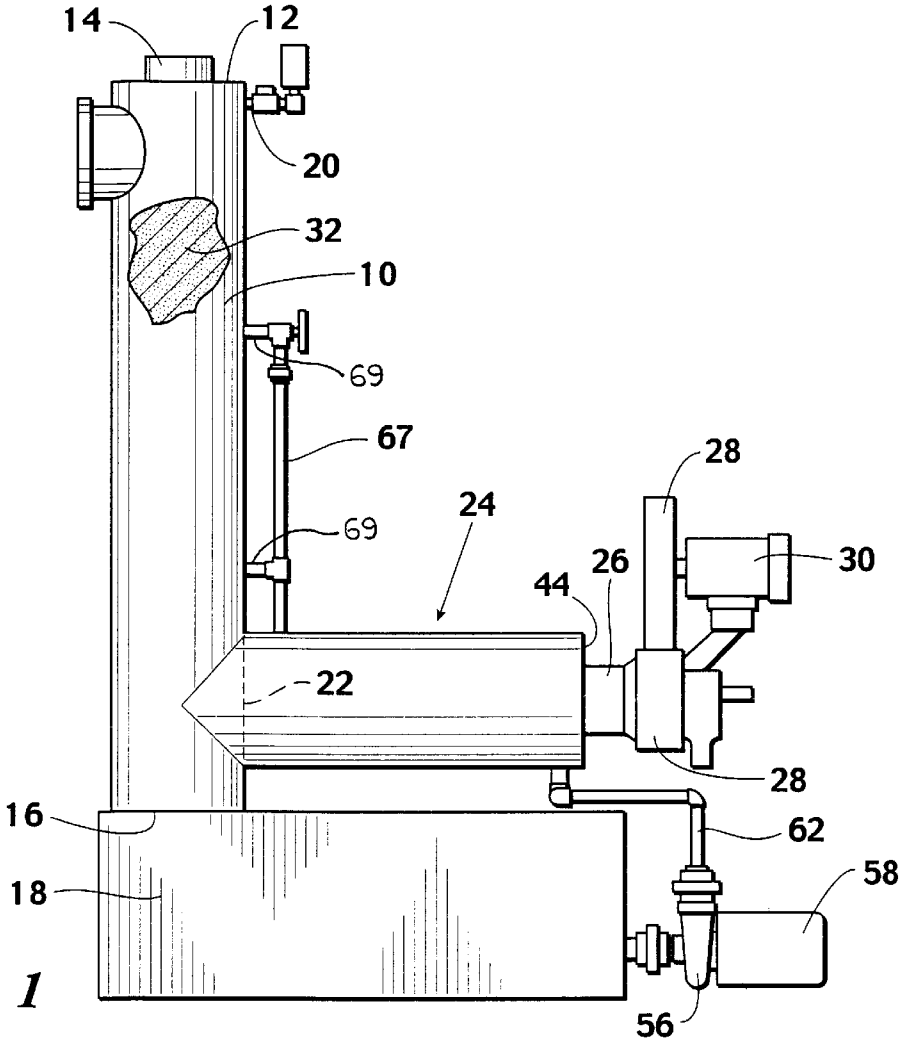
FIG. 1 is an elevational side view of a direct contact water heating system.

Referring to the drawings and first to FIGS. 1 and 2, a direct contact water heating system that employs the principles of this invention is illustrated. The system includes a vertical water tower 10 that is illustrated as being cylindrical but can be rectangular or of any other cross-sectional configuration. Tower 10 has a top end 12 in which is formed an exhaust gas vent 14. Tower 10 further has a bottom end 16 that, in the illustrated arrangement, rests on a hot water storage tank 18. This is by way of example only as the hot water storage tank 18 can be a separate vessel positioned adjacent to water tower 10. An inlet 20 is formed adjacent water tower top end 12 through which cold water is introduced into the interior of the water tower.

Formed in the wall of water tower 10 is a combustion inlet opening 22, seen in FIG. 3 and illustrated by a dotted line in FIG. 1. Extending from water tower 10 at combustion inlet opening 22 is a combustion chamber 24 that will be described in detail subsequently. Affixed to the outer end of combustion chamber 24 is a burner nozzle 26. A blower 28, driven by motor 30, provides a forced draft through the burner and combustion chamber to augment the burning of fuel within the combustion chamber. While blower 28, driven by motor 30, as illustrated and is a preferred way of providing draft of air through the combustion chamber, an induced draft system can be employed and which may be secured adjacent exhaust vent outlet 14.

Water tower 10 is partially filled with packing material 32 supported on a shelf (not shown) positioned above combustion inlet 22. Cold water entering water tower 10 through cold water inlet 20 is dispersed to pass evenly downwardly through packing 32.

An important aspect of the invention is the improved combustion chamber 26 which, in one embodiment is best illustrated in the enlarged, fragmentary cross-sectional view of FIG. 3. As previously stated, water tower 10 has a combustion inlet opening 22. Combustion chamber 24 has a cylindrical sidewall 34 that is supported to water tower 10 to encompass opening 22. Combustion chamber sidewall 34 extends generally horizontally from vertical water tower 10 and has an outer flange portion 36 having an opening therein that receives the inner end of burner nozzle 26.

Surrounding combustion chamber sidewall 34 is a cylindrical shell 38 having an inner end 40 that is secured to the water tower sidewall. Shell outer end 42 has secured to it a flange portion 44 with an opening 46 therein that is secured to the exterior of burner nozzle 26. Flange portion 44 is annular in configuration in the same manner that the combustion chamber sidewall flange portion 36 is annular with a confined area 48 in the space between flanges 36 and 44. Shell 38 is spaced from combustion chamber sidewall 34 leaving an annular cylindrical area 50. Thus, areas 48 and 50 provide a closed envelope surrounding combustion chamber 34 in all areas except at the combustion chamber open forward end 52 and at the rearward end opening 46 that receives burner nozzle 26.

Water that is heated in tower 10 passes directly downwardly into the hot water storage tank 18. To maintain a preselected temperature of water within storage tank 18, a recirculation pump 56 is illustrated, driven by motor 58. Water can be withdrawn from storage tank 18 through outlet opening 60 and pumped back through piping 62 and water inlet opening 64 into the closed envelope area 48 and 50 surrounding combustion chamber 24. Water is free to flow in the closed areas 48 and 50 that formed the closed envelope and through a weir passageway 68 where the water can flow back into the interior of water tower 10. This is but one method of circulating water through the closed envelope surrounding the combustion chamber. An outlet opening 66 provided in shell 38 is connected with piping 67 for input of water back into the water tower at other locations such as at locations 69 intermediate the top end 12 and bottom end 16 of the tower.

Further, FIG. 3 shows a system for compensating for thermal contraction and expansion that takes place when combustion chamber sidewall 34 is heated. For this purpose, an internal flange 70 is secured to the combustion chamber sidewall inner end 72, internal flange 70 having weir 68 formed therein as seen in FIG. 4. Internal flange 70 is free floating within shell 38. As expansion and contraction of combustion chamber cylindrical sidewall 34 takes place relative to the shell cylindrical sidewall 38 these members can be elongated longitudinally at different rates without creating strain between the two components. This concept is also not a part of the present invention but is illustrated to show the environment in which the improvements of this invention may be practiced. In like manner, FIGS. 3 and 4 show internal radial fins 84 to assist in transferring heat from within the combustion chamber to the combustion chamber sidewall 34 to improve efficiency of heat transfer. This concept has been previously shown and is not part of this invention.

Figure 5:
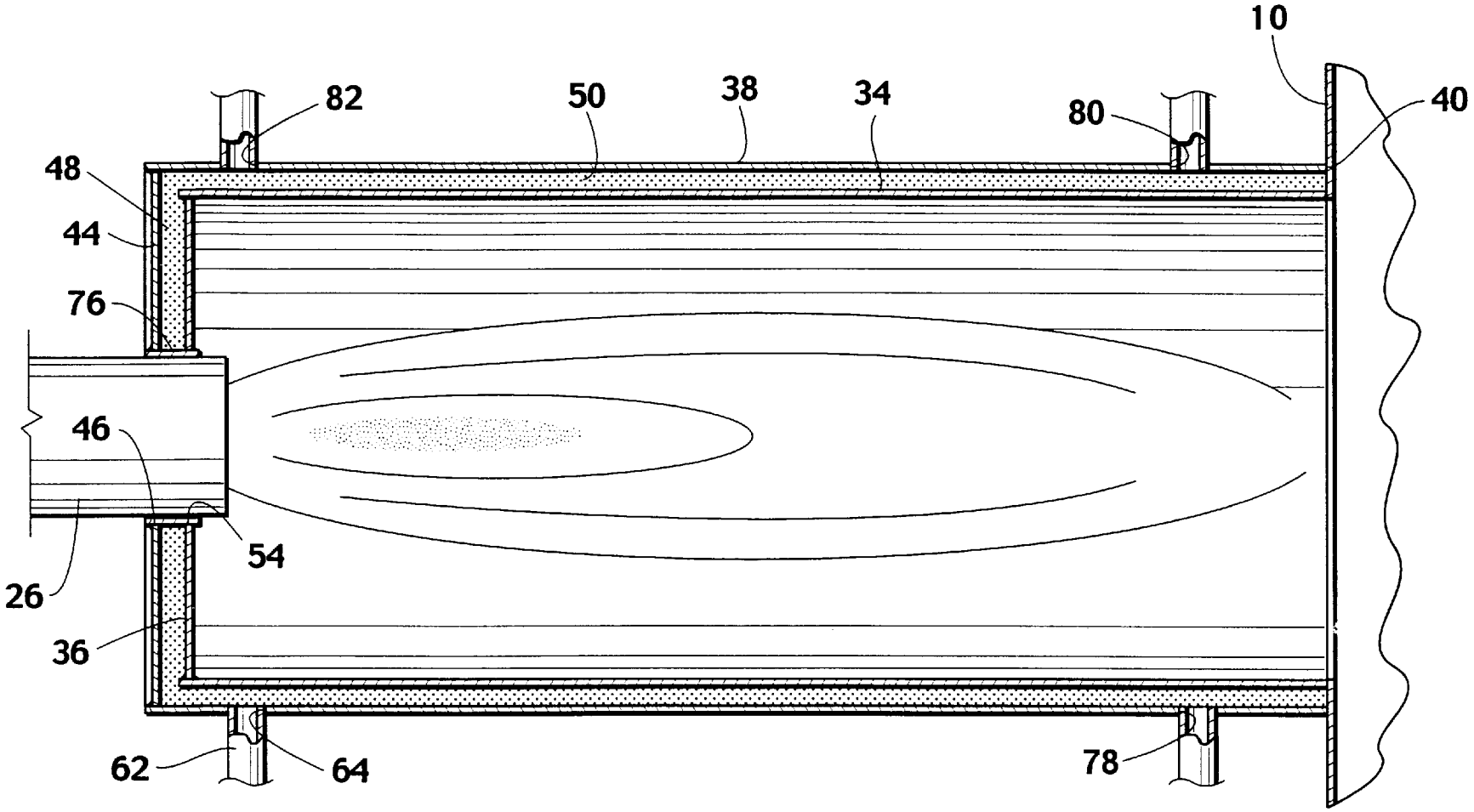
FIG. 5 is an elevational cross-sectional view of a combustion chamber for use in a direct contact water heating system in which an outer shell formed around the combustion chamber extends to encompass the combustion chamber end plate.

FIG. 5 shows the essence of the invention as revealed in FIGS. 1, 2 and 3 in somewhat greater detail and in an embodiment in which the combustion chamber is relatively longer than that illustrated in FIGS. 1, 2 and 3 while the principles remain the same. In the embodiment of FIG. 5 a short length tubular member 76 surrounds burner nozzle 26, the short length tubular member being welded to combustion chamber flange portion 36 at opening 54 and, in like manner, the tubular member 76 is welded to shell flange portion 44 at opening 46. Burner nozzle 26 is slidably received in tubular member 76 so as to allow relative thermally induced movement between the combustion chamber and burner nozzle 26.

As contrasted with FIGS. 3 and 4 which show the use of a weir for passage of the flow of water from within the closed envelope surrounding the combustion chamber, FIG. 5 shows an embodiment in which the combustion chamber inner end 72 and shell inner end 40 are welded directly to the water tank cylindrical sidewall 10.

FIG. 5 illustrates multiple openings in cylindrical shell 38 by which water can be conveyed to and from the closed envelope formed by areas 48 and 50. Openings 64 and 66 have previously been identified in FIG. 3. FIG. 5 shows additional openings 78 and 80 by which water may be circulated through the closed envelope surrounding the combustion chamber as required by a particular flowage arrangement for a direct contact water heating system. These openings are shown capped off in FIGS. 1 and 3.

FIG. 5 does not disclose the thermal compensation arrangement of FIG. 3 in which the inner end of combustion chamber sidewall 34 is free to float relative to shell sidewall 38, however this embodiment can be employed in the design of FIG. 5 if desired.

Figure 6:
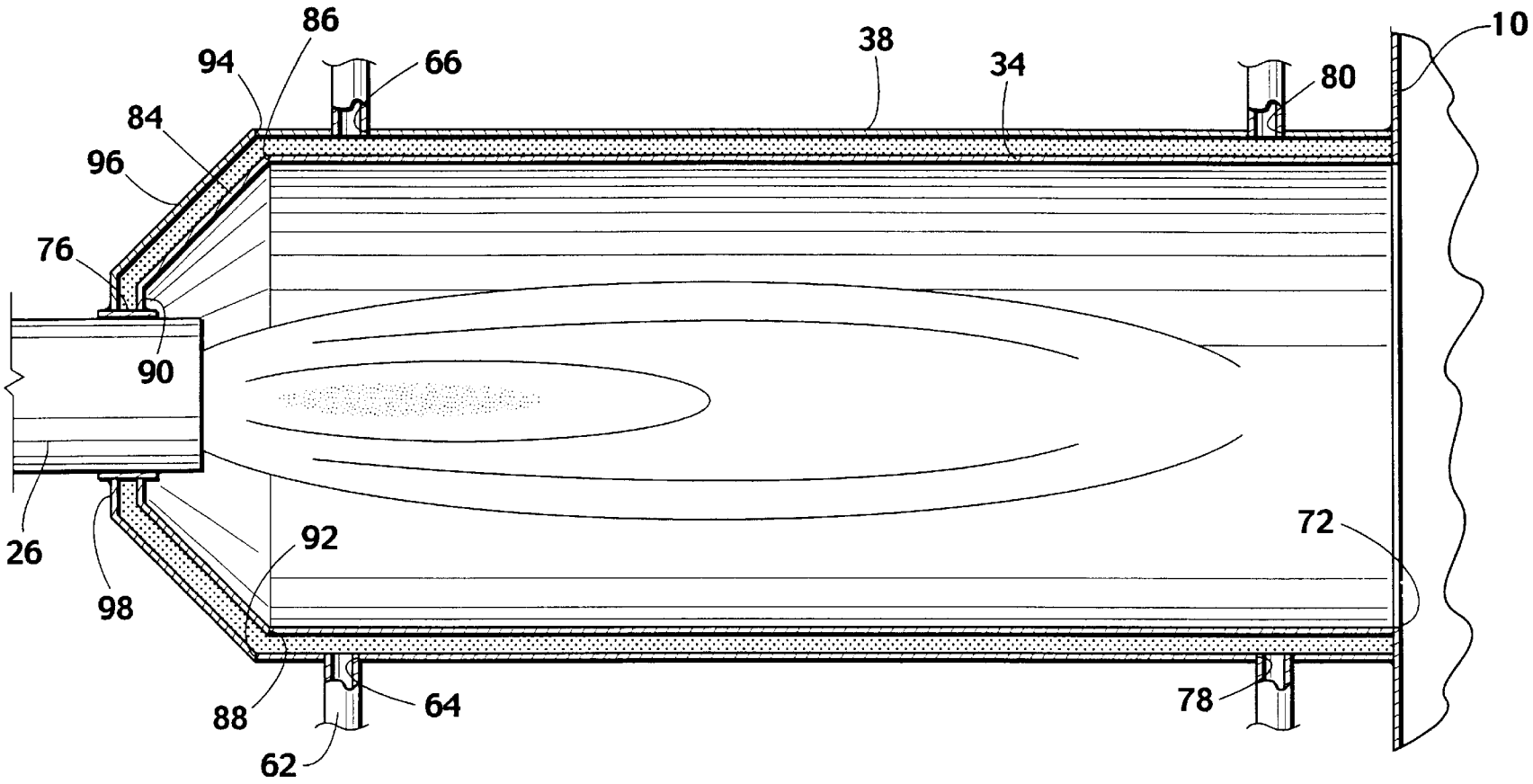
FIG. 6 is an elevational cross-sectional view of a further improved combustion chamber for use with a direct contact water heater. In the arrangement of FIG. 6 the end plate is in the shape of a frustum, that is, it is frusto-conical and tapers rearwardly to receive a burner nozzle. Further, a shell that contains water surrounding the frusto-conical end plate is also in the shape of a frustum. The end plate arrangement of FIG. 6 has increased rigidity as compared to a planar end plate such as shown in FIG. 5, to reduce the effect of vibration caused by the burner and reduced the effect of water pressure changes inside the water wall straining the metal past yield.

FIG. 6 shows an important alternate arrangement for constructing the combustion chamber for a direct contact water heater. In the embodiment of FIG. 6 the outer end of combustion chamber sidewall 34 is provided with a frusto-conical flange portion 84. This flange portion 84 that is in the shape of a frustum is of decreased internal diameter in the direction towards burner nozzle 26 and more specifically, towards short length tubular member 76. Specifically, the outer end 86 of combustion chamber 34 has secured to it the inner circumferential end 88 of frustum flange portion 84. Flange portion 84 tapers in reduced diameters to a small, radial flange portion 90 that is secured to tubular member 76.

In like arrangement, the outer end 92 of shell 38 receives the inner end 94 of a frusto-conical shell portion 96. The outer end of the frusto-conical portion 96 engages a radial flange portion 98 that, in turn, is secured to short length tubular member 76. The embodiment of FIG. 6 achieves reduced turbulence of combustion gases passing into the combustion chamber. Further, the arrangement of FIG. 6 adds substantially increased rigidity to the combustion chamber and shell end plate arrangement to significantly reduce vibration as compared with planar end plate arrangements and reduced the effect of water pressure changes inside the water wall pushing the metal past yield.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A direct contact water heating system comprising:

a water tower having a sidewall, having an upper and a lower end, having an exhaust vent adjacent the upper end, having a water outlet adjacent the lower end, having a combustion inlet opening in the sidewall spaced above the lower end and having a water receiving inlet adjacent the top end;

a combustion chamber having a sidewall in communication with said water tower combustion inlet and an end wall spaced from said water tower, the end wall having an opening therein;

a burner secured to said combustion chamber end wall having a combustion outlet in communication with said combustion chamber end wall opening, said combustion chamber end wall having an annular area surrounding said burner combustion outlet, products of combustion flowing from said burner and through said combustion chamber into said water tower through said combustion inlet opening;

a shell having an inner end attached to said water tower sidewall, a sidewall portion surrounding at least a substantial portion of said combustion chamber sidewall and an annular portion spaced exteriorly of said annular area of said combustion chamber end wall, an interior surface of the shell and an exterior surface of said combustion chamber forming a closed envelope having a water inlet and a separate water outlet; and a pump activated flow system to circulate water through said envelope so as to cool said combustion chamber.

2. A direct contact water heating system according to claim 1 including:

a hot water storage connected to said water tower water outlet and wherein said flow system includes passageways to circulate water from the hot water storage through said closed envelope.

3. A direct contact water heating system according to claim 1 including a blower for producing air flow through said combustion chamber.

4. A direct contact water heating system according to claim 3 including:

packing positioned within said water tower permitting water to flow downwardly therethrough and products of combustion to flow simultaneously upwardly therethrough.

5. A direct contact water heating system according to claim 2 wherein said water tower includes an intermediate water inlet and including a passageway to recirculate water from said hot water storage to the intermediate water inlet to provide a water inlet stream which is injected into the tower at a point intermediate said upper end and lower end.

6. A direct contact water heating system according to claim 5 wherein said passageway to recirculate water from said hot water storage is interconnected with said pump-activated flow system to pass water through said closed envelope.

7. A direct contact water heating system according to claim 1 wherein said pump-activated flow system that circulates water through said closed envelope includes a weir in an upper portion of said closed envelope at said water tower sidewall.

8. A direct contact water heating system according to claim 1 wherein said combustion chamber has a circumferential interior surface and at least one fin secured to the interior surface by which increased heat is transferred to said combustion chamber sidewall and thereby to said closed envelope.

9. A direct contact water heating system according to claim 8 including a plurality of spaced apart fins secured to said interior surface of said combustion chamber.

10. A direct contact water heating system according to claim 8 wherein said at least one fin secured to said combustion chamber interior surface is formed in a spiral.

11. A direct contact water heating system according to claim 1 wherein said combustion chamber has an inner end adjacent said water tower sidewall and an outer end, wherein said combustion chamber outer end is fixed with respect to said shell and wherein said inner end is free floating with respect to said water tower sidewall and said shell.

12. A direct contact water heating system according to claim 1 wherein said combustion chamber end wall annular area is at least substantially planar and said shell annular portion is at least substantially planar.

13. A direct contact water heating system according to claim 1 wherein said combustion chamber end wall is at least substantially frusto-conical and tapering in reducing internal diameters towards said opening therein and wherein said shell annular portion is at least substantially frusto-conical.

14. A direct contact water heating system comprising:

a water tower having a sidewall with a combustion inlet opening therein;

a combustion chamber having a sidewall in communication with said water tower combustion inlet and an end wall spaced from said water tower, the end wall having a burner opening therein, the combustion chamber end wall tapering in a frustum from said sidewall towards the burner opening;

a burner having an outlet nozzle in communication with said combustion chamber end wall opening, products of combustion flowing from said burner and through said combustion chamber into said water tower through said combustion inlet opening;

a shell having an inner end attached to said water tower sidewall and having a shell sidewall portion surrounding at least a substantial portion of said combustion chamber sidewall and a shell end wall portion spaced exteriorly of said combustion chamber end wall, an interior surface of the shell and an exterior surface of said combustion chamber forming a closed envelope having a water inlet and a separate water outlet; and a pump-activated flow system wherein said pump has an output connected to said water inlet so as to circulate water through said closed envelope and out of said water inlet to cool said combustion chamber sidewall and end wall.

15. A direct contact water heating system according to claim 14 wherein said flow system includes piping arranged to pass water through said closed envelope and then into an upper portion of said water tower.

16. A direct contact water heating system according to claim 14 wherein said flow system includes piping to recirculate water from said water outlet and into an intermediate portion of said water tower.

17. A direct contact water heating system according to claim 14 wherein said flow system includes an opening in said water tower sidewall in communication with said closed envelope through which water passes into or out of said closed envelope.

18. A direct contact water heating system according to claim 14 wherein said shell end wall portion is shaped at least substantially as a frustum and is spaced from said combustion chamber end wall.

* * * * *